US006932643B2

(12) United States Patent
Bigotto

(10) Patent No.: US 6,932,643 B2
(45) Date of Patent: Aug. 23, 2005

(54) SHORT CIRCUIT ELECTRICAL CONNECTOR

(75) Inventor: Pier Carlo Bigotto, Cascine Vica-Rivoli (IT)

(73) Assignee: FCI, Paris (FR)

( * ) Notice: Subject to any disclaimer, the term of this patent is extended or adjusted under 35 U.S.C. 154(b) by 118 days.

(21) Appl. No.: 10/312,180

(22) PCT Filed: Jun. 19, 2001

(86) PCT No.: PCT/EP01/06920

§ 371 (c)(1),
(2), (4) Date: Jul. 21, 2003

(87) PCT Pub. No.: WO01/99238

PCT Pub. Date: Dec. 27, 2001

(65) Prior Publication Data

US 2004/0102086 A1 May 27, 2004

(30) Foreign Application Priority Data

Jun. 20, 2000 (IT) ..... TO2000A0599

(51) Int. Cl.[7] ..... H01R 31/08
(52) U.S. Cl. ..... 439/507; 439/912; 439/188
(58) Field of Search ..... 439/507–514, 439/188, 912

(56) References Cited

U.S. PATENT DOCUMENTS

| | | | | |
|---|---|---|---|---|
| 5,263,872 A | * 11/1993 | Marpoe et al. | ..... | 439/188 |
| 5,588,855 A | * 12/1996 | Nankoh | ..... | 439/188 |
| 6,419,510 B2 | * 7/2002 | Shiraki et al. | ..... | 439/188 |
| 6,645,003 B2 | * 11/2003 | Yoshida et al. | ..... | 439/507 |
| 6,663,421 B1 | * 12/2003 | Glick et al. | ..... | 439/507 |

FOREIGN PATENT DOCUMENTS

| | | |
|---|---|---|
| DE | 4428323 A1 | 2/1995 |
| EP | 0655806 A2 | 5/1995 |
| EP | 0949719 A1 | 10/1999 |

* cited by examiner

*Primary Examiner*—Gary Paumen
(74) *Attorney, Agent, or Firm*—Perman & Green, LLP

(57) ABSTRACT

An electric connector (2) having an insulating casing (15) defining at least two cavities (16) for housing respective electric terminals (17); short-circuit means (55) carried by the casing (15) and which can be set to a first operating configuration mutually connecting the terminals (17), and a second operating configuration isolated electrically from the terminals (17); and a manually operated short-circuit cutoff device (61) carried by the casing (15) and which can be activated selectively to move the short-circuit means (55) from the first to the second operating configuration.

8 Claims, 4 Drawing Sheets

SHORT CIRCUIT ELECTRICAL CONNECTOR

This application claims the benefit of the earlier filed International Application No. PCT/EP01/06920, International Filing Date, Jun. 19, 2001, which designated the United States of America, and which international application was published under PCT Article 21(2) as WO Publication No. WO 01/99238 A1.

TECHNICAL FIELD

The present invention relates to an electric connector, in particular of the type connectable to an automotive safety system activating circuit, e.g. to an air-bag system, to which the following description refers purely by way of example.

BACKGROUND ART

Connectors of the above type are known, are connected in a fully assembled position to a complementary connector to define an electric connecting unit, and substantially comprise an insulating casing having at least two longitudinal cavities for respective electric terminals.

Such connectors, hereinafter referred to for the sake of simplicity as "short-circuited connectors" also comprise at least one elastic short-circuit blade carried by the relative casing and normally set to an undeformed activating configuration connecting the terminals to prevent accidental activation of the air-bag system detonating device in the event the terminals are accidentally brought into contact with an electric source, or to prevent electrostatic discharge current flow through the detonating device.

When the short-circuited and complementary connectors are connected, the short-circuit blade is moved from the undeformed activating configuration to a deformed deactivating configuration in which it is detached from the terminals by an interacting portion of the complementary connector casing, and into which the short-circuit blade is moved when the short-circuited and complementary connectors are fully assembled.

Particularly when used in automotive safety systems, short-circuited connectors of the type briefly described above are subjected, before and during on-vehicle assembly, to long, painstaking tests as described below.

First of all, the short-circuited connector is connected to an auxiliary connector, the load of which is defined by a resistor with a predetermined resistance, to define a test assembly. The auxiliary connector is similar to the complementary connector and has an interacting portion which cooperates with the short-circuit blade to set and keep it in the deactivating configuration, i.e. detached from the relative electric terminals.

To determine any malfunctioning, a resistance measurement is made of the electric circuits defined respectively by the test assembly and by the short-circuited connector with the short-circuit blade in the activating configuration.

At this point, the auxiliary connector is removed, and the short-circuited connector is fitted to the complementary connector in the fully assembled position in which the short-circuit blade is set to the deactivating configuration, and a further resistance measurement is made to test correct connection of the connectors.

Finally, the auxiliary connectors of the connecting units fitted to each vehicle are collected in a container and counted by the operator once the vehicle is wired to further ensure all the connections have been made.

DISCLOSURE OF INVENTION

It is an object of the present invention to provide an electric connector designed to eliminate, in a straightforward, reliable, low-cost manner, the drawback of known connectors as described above, and which in particular provides for simplifying and speeding up testing of the connector.

According to the present invention, there is provided an electric connector comprising an insulating casing defining at least two cavities for housing respective electric terminals; and short-circuit means carried by said casing and which can be set to a first operating configuration in which said short-circuit means mutually connect said terminals, and at least a second operating configuration in which said short-circuit means are isolated electrically from said terminals; characterized in that said casing is provided with a movable actuating member cooperating with an actuation area of said short-circuit means to displace said short-circuit means from said first to said second operating configuration.

BRIEF DESCRIPTION OF THE DRAWINGS

A preferred, non-limiting embodiment of the present invention will be described by way of example with reference to the accompanying drawings, in which.

BEST-MODE FOR CARRYING OUT THE INVENTION

Figure 1:
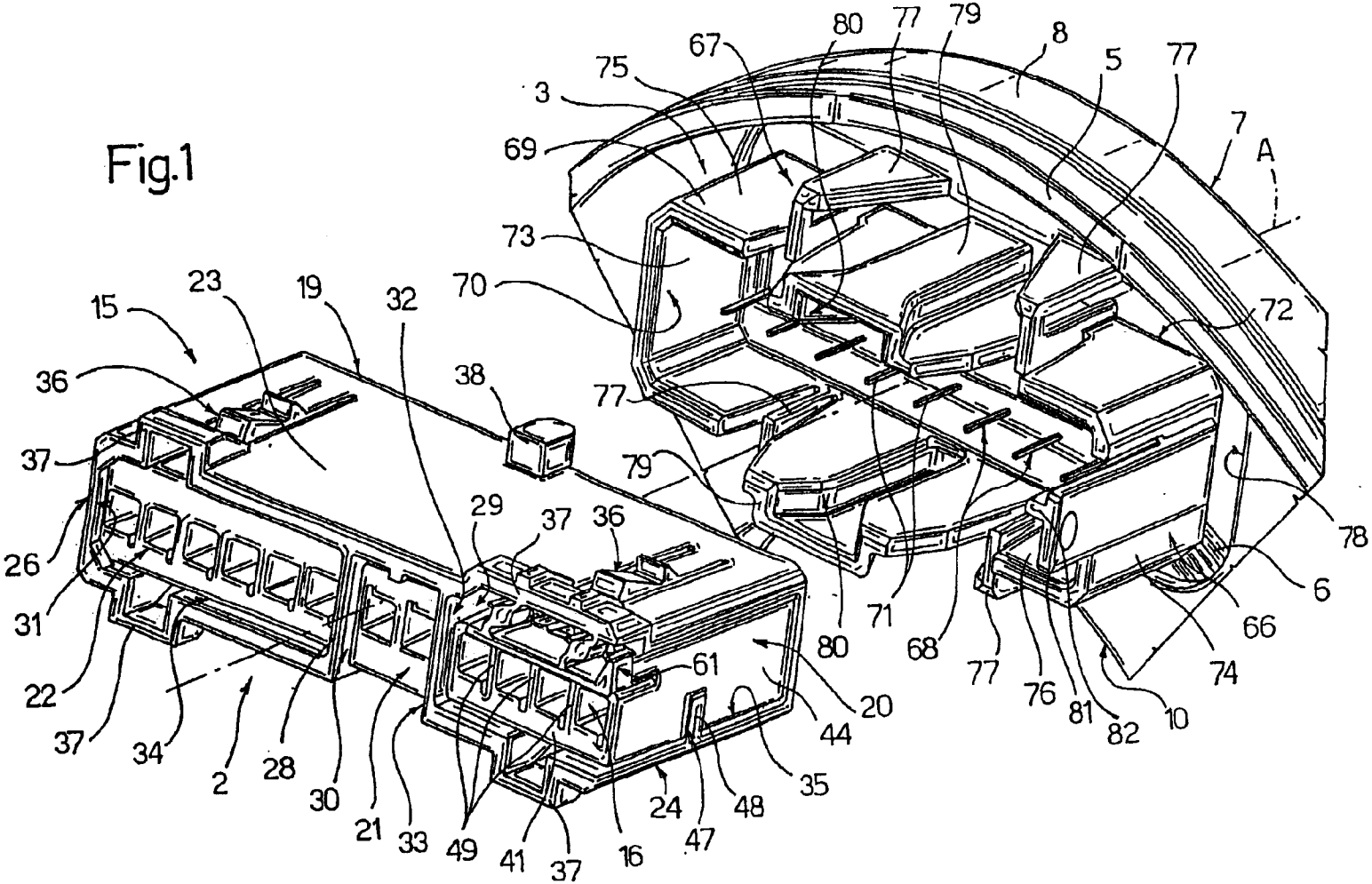
FIG. 1 shows an exploded view in perspective, with parts removed for clarity, of an electric connecting unit, comprising an electric plug connector, in accordance with the present invention, and a complementary electric jack connector.

Number 1 in FIG. 1 indicates as a whole an electric connecting unit comprising a plug connector 2 and a jack connector 3 carried by respective supporting members 4 and 5—in the example shown, a base disk of a vehicle steering wheel, and a circular plate integral with a known steering column (not shown) connected coaxially to the steering wheel.

Connectors 2 and 3 are connected to each other in an assembly direction A and in a fully assembled position (not shown) by fitting the steering wheel to the vehicle steering column, i.e. by connecting supporting members 4 and 5.

Unit 1 is used to connect a number of known electric devices (not shown), normally located on the vehicle steering wheel (air-bag safety system detonating device, horn, radio control members, etc.), to a flexible circuit 6 with parallel conductive tracks, commonly known as a "flat cable", which is connected to respective drive units (not shown) of the electric devices. More specifically, circuit 6 is coiled about the steering column and housed in a box body 7 (only shown partly in FIG. 1) defined by a fixed, substantially cylindrical base member 8, and by supporting member 5 fitted for rotation to base member 8.

Supporting member 4 is substantially circular and has a central through hole. (not shown) engaged by a complementary portion of the steering column; and a peripheral through opening 9 having a substantially rectangular beveled-cornered lateral, edge and engaged in use by connector 2.

Supporting member 5 has a central through hole 10 engaged by the steering column, and is advantageously made of plastic material and integrally with connector 3.

It should be pointed out that the terms "top", "bottom", "front", "rear" and similar used in the following description are in no way limiting, and are used purely for the sake of clarity with reference to the approach position of connectors 2 and 3 at the assembly stage shown in FIG. 1.

With particular reference to FIGS. 1, 2, 5, 6 and 7, connector 2 comprises an externally substantially parallelepiped-shaped insulating casing 15 defining a row of through cavities 16 having respective axes parallel to direction A and for receiving respective female electric terminals 17 (FIGS. 6 and 7) retained one-way inside cavities 16 by known click-on retaining means not shown by not forming part of the present invention.

Terminals 17 are crimped to respective electric cables 18 in turn connected to the drive units of the electric devices fitted to the vehicle steering wheel.

More specifically, casing-15 comprises a substantially parallelepiped-shaped outer box body 19; and three substantially parallelepiped-shaped inner or terminal-holder modules 20, 21, 22—four-, two- and six-way respectively—housed inside body 19 and defining cavities 16 for receiving terminals 17.

Body 19 comprises two parallel, rectangular, respectively top and bottom walls 23, 24 connected along two side by respective rectangular, respectively front and lateral walls 25, 26 perpendicular to each other and walls 23, 24.

Front wall 25 extends perpendicularly to direction A and comprises a number of rectangular through openings 27 defining respective outlets of cavities 16.

Body 19 also comprises two inner partitions 28 extending parallel to lateral wall 26 between walls 23 and 24 and dividing body 19 into three compartments 29, 30, 31 for housing respective modules 20, 21, 22. On the opposite side to front wall 25, body 19 defines three outlets 32, 33, 34 for, and having substantially the same section as, respective compartments 29, 30, 31.

Walls 23, 24, 25 define, on the opposite side to wall 26, a C-shaped lateral opening 35 communicating at one end with adjacent opening 32, also C-shaped, so that relative compartment 29 is open on two sides.

Body 19 also comprises four elastic retaining members 36 (not described in detail by not forming part of the present invention) carried in pairs on walls 23 and 24, and which click onto the lateral edge of opening 9 of supporting member 4 to define a one-way connection condition of connector 2 to supporting member 4. More specifically, retaining members 36 prevent withdrawal of connector 2 from opening 9 of supporting member 4 in the opposite direction to direction A.

Retaining members 32 on each wall 23, 24 are located on opposite sides of a plane of symmetry of body 19 perpendicular to walls 23, 24 and to wall 25, and extend close to wall 26 and opening 35 respectively.

Body 19 also comprises four stop members 37, which project outwards in pairs from walls 23 and 24, are located close to the rear edges of walls 23, 24 and facing respective retaining members 36, and cooperate with the lateral edge of opening 9 of supporting member 4 to prevent withdrawal of connector 2 from supporting member 4 in direction A.

Body 19 also comprises two centering projections 38, which project outwards from respective end walls 23 and 24, extend close to front wall 25, are each located in an intermediate position between retaining members 36 of relative wall 23, 24, and, as explained in more detail later on, provide for centering connector 2 with respect to direction A at a first stage in the connection to connector 3.

Hereinafter, the description of connector 2 will be limited to a detailed description of module 20 specifically defining the object of the present invention.

Module 20 provides for connecting the air-bag safety system detonating device to the relative drive unit, and is defined by a substantially parallelepiped-shaped body in which are formed four cavities 16.

More specifically, module. 20 is defined by a rear wall 41 from which electric cables 18 project; by a front wall 42 opposite and parallel to wall 41; by two lateral walls 43, 44 parallel to direction A and perpendicular to the direction in which the row of cavities 16 extends; and by two parallel, respectively top and bottom end walls 45, 46.

More specifically, walls 42, 46 and 43 are positioned in use respectively contacting walls 25, 24 and partition 28 of body 19 defining compartment 29; walls 41, 44 in use respectively engage openings 32, 35 of body 19; and wall 42 comprises a number of through openings 42*a* aligned, in use, with respective openings 27 in wall 25 of body 19 and defining respective outlets for cavities 16.

Of end walls 45, 46, top wall 45 is positioned parallel to and facing top wall 23 of body 19, and bottom wall 46 is positioned contacting bottom wall 24 of body 19.

Wall 46 comprises a through slot 47 extending perpendicularly to direction A and to lateral walls 43, 44 and engaged, in use, by a complementary rib 48 projecting inwards of compartment 29 from bottom wall 24 of body 19.

Module 20 is inserted inside compartment 29 of body 19 through lateral opening 35 and in a direction B perpendicular to direction A by fitting and sliding slot 47 along rib 48. More specifically, during insertion inside compartment 29, walls 42 and 46 of module 20 slide along walls 25 and 24 of body 19 and full connection of module 20 to body 19 is defined by known click-on retaining means (not shown) which are activated upon lateral wall 43 of module 20 contacting the relative partition 28 defining compartment 29.

Module 20 also comprises a number of intermediate walls 49 parallel to lateral walls 43, 44 and defining, with walls 43, 44, 45, 46, the relative row of cavities 16.

Figure 2:
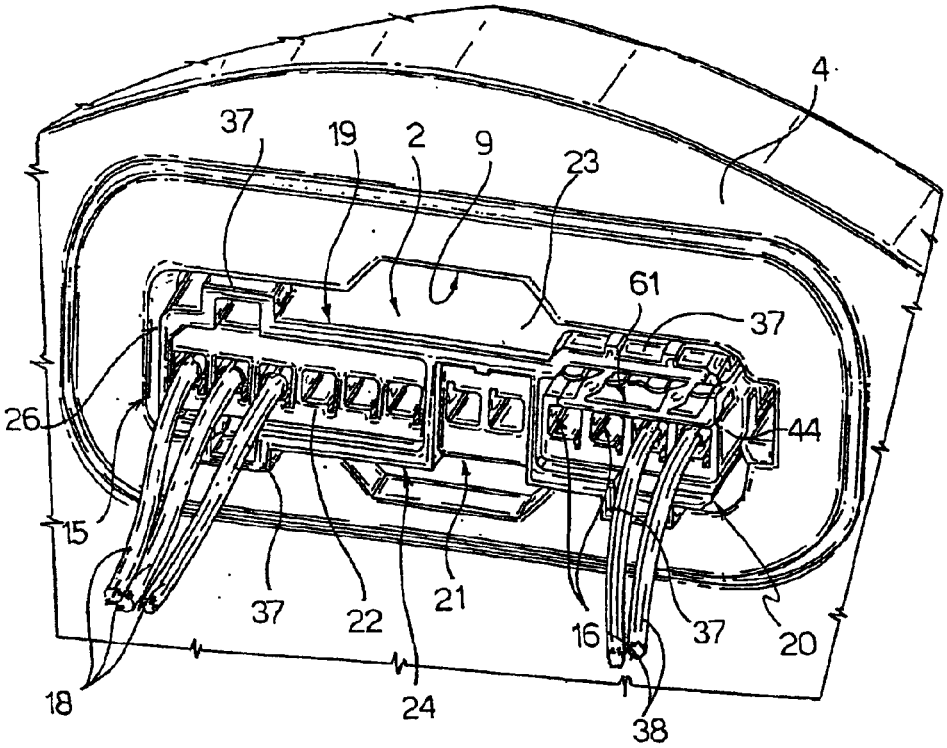
FIG. 2 shows a larger-scale front view in perspective of the FIG. 1 plug connector prior to connection to the jack connector.
Figure 5:
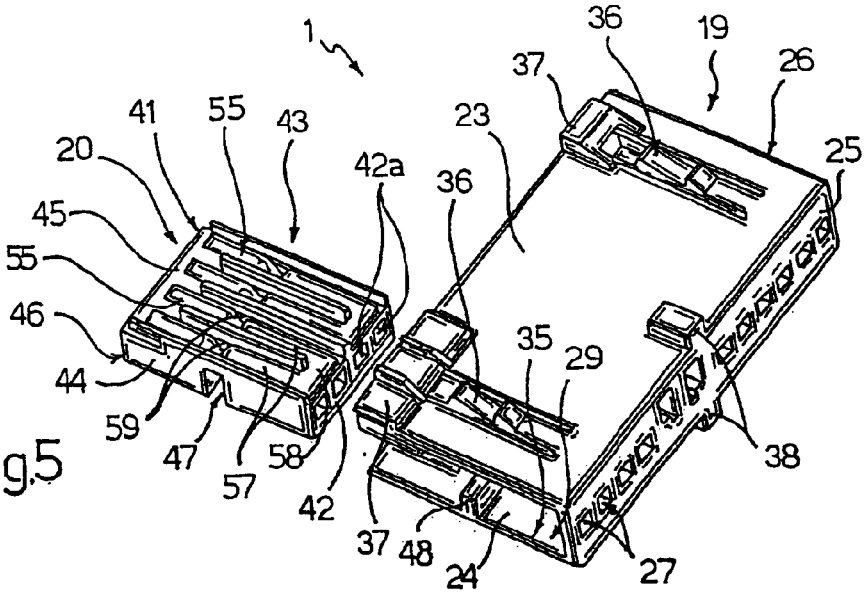
FIG. 5 shows an overview in perspective of the FIG. 2 plug connector being assembled.
Figure 3:
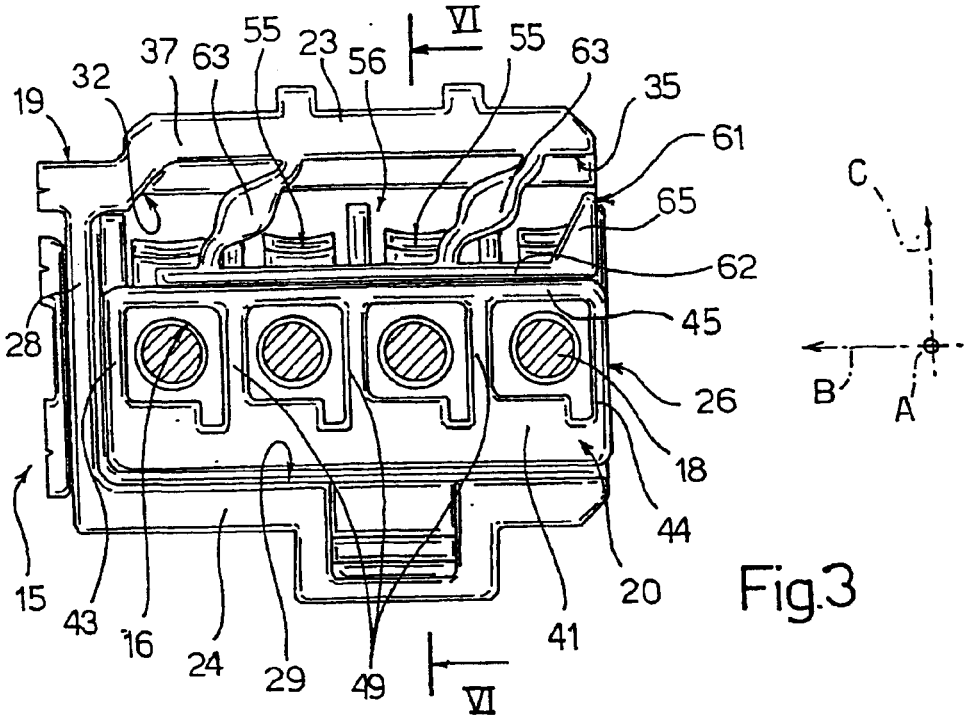
FIGS. 3 and 4 show larger-scale front views of a detail of the FIG. 2 plug connector in two different operating configurations.
Figure 4:
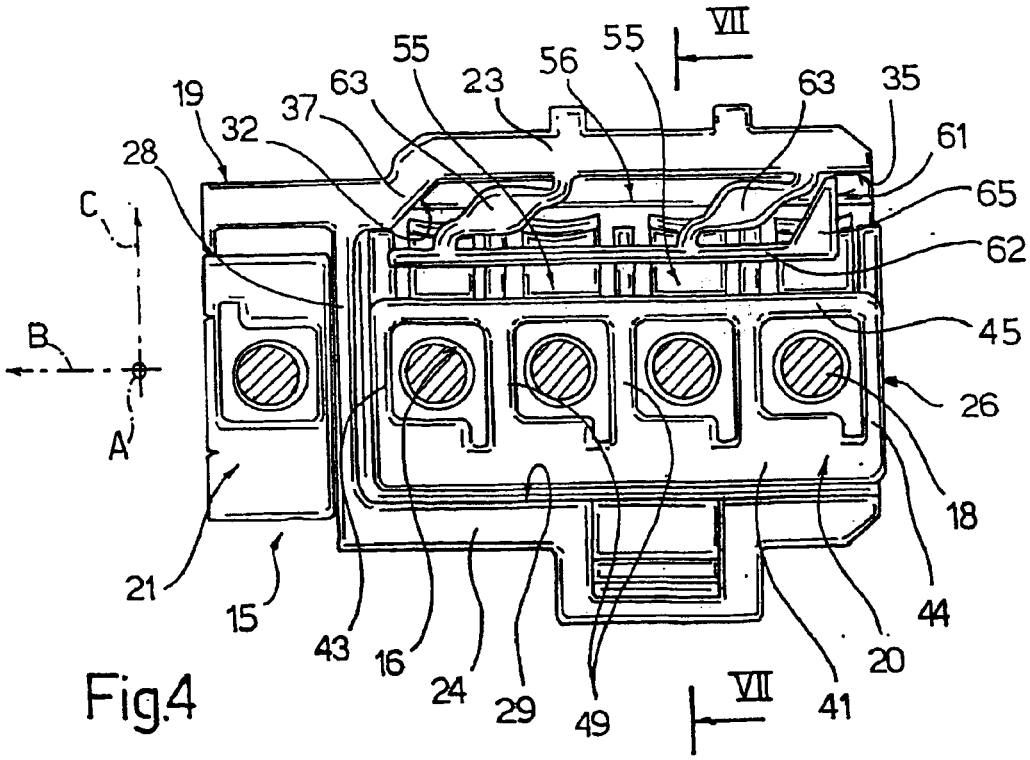
Figure 6:
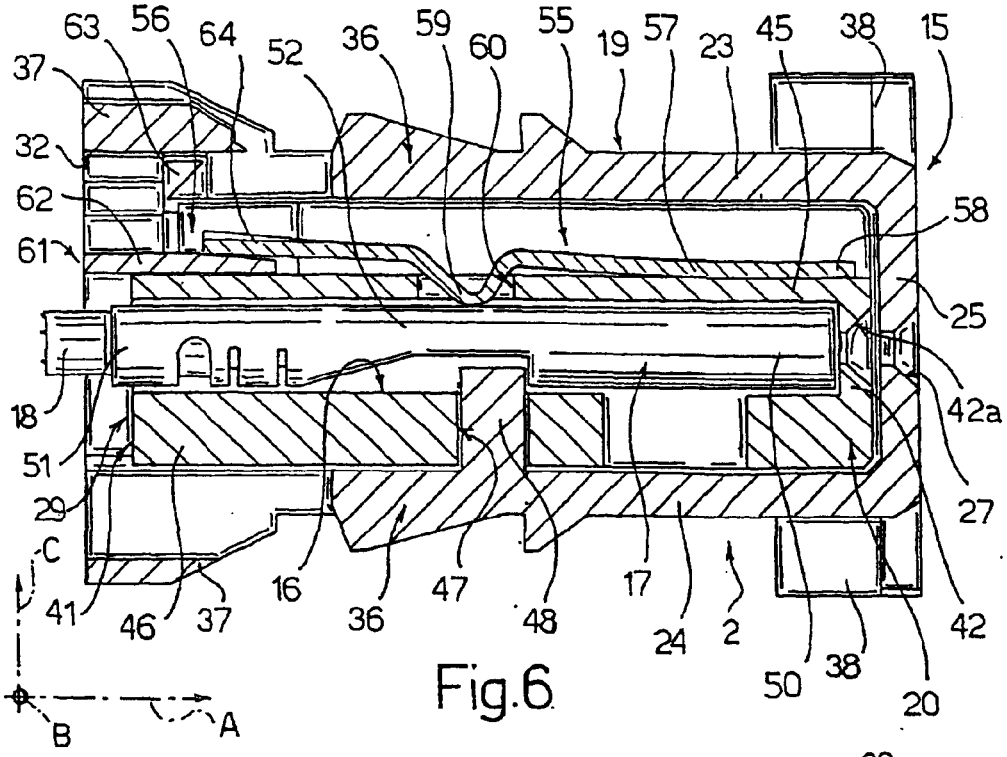
FIG. 6 shows a section along line VI—VI in FIG. 3.
Figure 7:
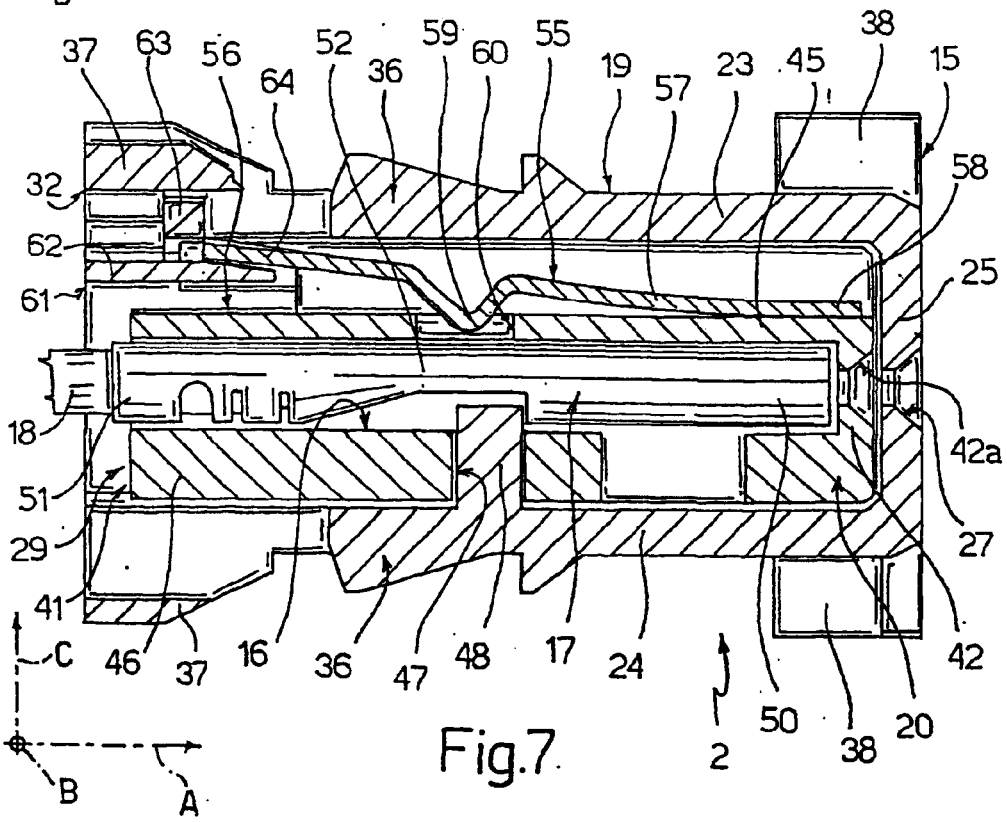
FIG. 7 shows a section along line VII—VII in FIG. 4.

With particular reference to FIGS. 6 and 7, each terminal 17 of module 20 comprises in known manner a box-shaped contact portion 50 facing front wall 42 of module 20; a connecting portion 51 for connection to respective electric cable 18; and an intermediate portion 52 connecting portions 50 and 51. As shown in FIGS. 2, 6 and 7, electric cables 18 of module 20 project from body 19 through opening 32 of compartment 29.

More specifically, contact portion 50 of each terminal 17 projects towards bottom wall 46 of module 20 with respect to intermediate portion 52, and, in use, rests against rib 48 so that, when module 20 is inserted inside body, 19, rib 48 determines correct assembly of terminals 17 inside respective cavities 16 and, in addition to said click-on retaining means, further ensures safe retention of terminals 17 inside body 19.

With reference to the accompanying drawings, connector 2 also comprises two short-circuit members 55 located on the outside of top wall 4S of module 20 and housed inside compartment 29 of body 19 in a region 56 defined on opposite sides by walls 45 and 23.

Each short-circuit member 55 is defined by a predominantly flat, substantially U-shaped elastic blade comprising two elongated branches 57 connected at one end by a connecting portion 58; and each branch 57 has an intermediate contact portion 59 having a substantially V-shaped section and which contacts relative terminal 17.

Short-circuit members 55 are located on the outside of top wall 45 of module 20 and are fixed to wall 45 at connecting portions 58 by known anchoring means not shown. More specifically, connecting portions 58 of short-circuit members 55 are located adjacent to front wall 42 of module 20, and branches 57 extend from connecting portions 58 along relative cavities 16.

Each short-circuit member 55 is normally set to an undeformed activating configuration (FIG. 6) in which it rests completely on top wall 45 of module 20, with contact portions 59 projecting inside respective cavities 16 through two through openings 60 in wall 45 so as to contact and connect respective terminals 17.

Each short-circuit member 55 can also be set selectively to a deformed deactivating configuration (FIG. 7) in which branches 57 are flexed in a direction C perpendicular to directions A and B, are raised with respect to top wall 45 of module 20 and connecting portion 58, and are moved towards top wall 23 of body 19 to detach contact portions 59 from, and so electrically disconnect, terminals 17.

An important aspect of the present invention is that connector 2 also comprises a manually operated short-circuit cutoff device 61 carried by casing 15 and which can be activated selectively to move short-circuit members 55 from the undeformed activating configuration to the deformed deactivating configuration regardless of the connection of connectors 2 and 3.

More specifically, short-circuit cutoff device 61 comprises a platelike actuating member 62 housed inside region 56 of compartment 29 of body 19, at opening 32, and suspended from a rear edge portion of top wall 45 of body 19 by two parallel elastic connecting arms 63 of the same length. Arms 63 are aligned substantially in a plane perpendicular to direction A, extend obliquely with respect to actuating member 62 and walls 23 and 45 of body 19 and module 20, and have respective outwardly-curved intermediate portions.

In the absence of external stress, actuating member 62 is maintained by the arms in a lowered position resting on wall 45 of module 20 and surmounted by respective free end portions 64 of branches 57 of short-circuit members 55.

Arms 63, actuating member 62 and the portion of wall 45 of body 19 extending between arms 63 may be likened to an articulated parallelogram structure, so that actuating member 62 can only move parallel to itself, in a direction perpendicular to direction A and obliquely with respect to walls 23 and 45 of body 19 and module 20, into a raised position detached from wall 45 of module 20 and in which actuating member 62 keeps branches 57 of short-circuit members 55 flexed in direction C to define the deformed deactivating configuration of short-circuit members 55. The raised position of actuating member 62 is defined by click-on connection of actuating member 62 and known retaining means (not shown) carried by body 19.

Actuating member 62 also comprises an integral end projection 65 projecting through lateral opening 35 of body 19, and which is pushed manually towards partition 28 defining compartment 29 to move actuating member 62 from the lowered to the raised position.

With reference to FIG. 1, jack connector 3 comprises a substantially parallelepiped-shaped insulating casing 66 in turn comprising a rear portion 67 having a number of longitudinal through cavities (not shown) for housing respective male electric terminals 68, and a hollow front portion 69 communicating with said cavities and defining a substantially parallelepiped-shaped compartment 70 for housing casing 15 of connector 2.

Like connector 2, terminals 68 and, therefore, the respective cavities housing them, have respective axes parallel to direction A, and are aligned in one row crosswise to direction A.

Each terminal 68 is welded at one end to flexible circuit 6, and has, at the opposite end a pin-type contact portion 71 projecting inside compartment 70.

Casing 66 is defined by a rear wall 72 from which flexible circuit 6 projects; by two opposite lateral walls 73, 74 parallel to direction A and perpendicular to the direction in which the row of terminals 68 extends; and by two opposite end walls 75, 76—respectively top and bottom with reference to the position of connector 3 in FIG. 1—perpendicular to walls 72, 73 and 74.

Casing 66 is connected to supporting member 4 by four leaf spring connecting members 77 (not described in detail by not forming part of the present invention), which are flexible perpendicularly with respect to direction A to permit, during connection, correct alignment of casings 66 and 15 with respect to direction A.

More specifically, casing 66 is suspended by connecting members 77 from the lateral edge of a rectangular beveled-cornered through opening 78 in supporting member 4, and is positioned with rear wall 72 facing opening 78.

Connecting means 77 project outwards in pairs from end walls 75, 76 of casing 66, and are connected to respective straight portions, adjacent and parallel to walls 75, 76, of the lateral edge of opening 78.

Each end wall 75, 76 comprises, in an intermediate position, a hollow projecting portion 79, which defines a substantially funnel-shaped seat 80 for receiving a respective projection 38 of body 19 of connector 2, and interacts with projection 38 to align casing, 66, by virtue of the flexibility of connecting members 77, with casing 15 of connector 2 when connecting casings 66 and in direction A.

From lateral wall 74 of casing 66 on the same side as lateral wall 44 of module 20, a tab 81 projects frontwards, is flexible in a direction perpendicular to lateral wall 74, and has an integral shim 82 which cooperates with projection 65 of actuating member 62. More specifically, in the fully assembled position of connectors 2 and 3, tab 81 projects through opening 9 of supporting member 4, on the opposite side of supporting member 4 with respect to supporting member 5, and can be pushed manually in direction B to move actuating member 62 from the lowered to the raised position.

Connecting unit 1 is assembled as follows.

Connector 2 is inserted in direction A through opening 9 of supporting member 4 into a connection position determined by retaining members 36 clicking onto the lateral edge of opening 9.

At this point, supporting member 4 is pushed in direction A towards supporting member 5 so that projections 38 of connector 2 are inserted inside seats 80 of projecting portions 79 of connector 3. At this stage, casing 15 is still located outside compartment 70 of casing 66.

If, owing to their own assembly tolerances, supporting members 4 and 5 are misaligned angularly with respect to direction A, the interaction of projections 38 of connector 2 with respective projecting portions 79 of connector 3 and the flexibility of connecting members 77 move casing 66 with respect to supporting member 5 in a direction perpendicular to direction A until casing 66 is aligned correctly with casing 15 of connector 2.

As supporting member 4 is pushed further in direction A, supporting member 4 is connected to supporting member 5 and casing 15 is inserted fully inside casing 66 to achieve the fully assembled position of connectors. 2 and 3, in which female terminals 17 of connector 2 are connected to the corresponding male terminals 68 of connector 3, short-circuit members 455 are still set to the undeformed activating configuration, and tab 81 projects through opening 9 of supporting member 4, on the opposite side to supporting member 5 and in a position accessible by the operator.

By acting manually on tab 81, actuating member 62 is pushed, by means of projection 65, in direction B and, by virtue of the connection defined by arms 63, moves simultaneously in direction B and towards top wall 23 of body 19 into the raised position. That is, at this stage, the movement of actuating member 62 in direction B increases the slope of arms 63 with respect to wall 23 of body 19 so as to raise actuating member 62.

As it moves, actuating member 62 takes with it the free end portions 64 of branches 57 of short-circuit members 55, thus detaching contact portions 59 of branches 57 from relative terminals 17 and allowing short-circuit members 55 to move into the deformed deactivating configuration.

The advantages of connector 2 according to the present invention will be clear from the foregoing description.

In particular, by providing a manually operated short-circuit cutoff device (61) directly on connector 2 fitted with short-circuit members 55, short-circuit members 55 can be deactivated regardless of the connection of connectors 2 and 3, thus enabling, for example, correct operation of short-circuit members 55 to be tested with no need for auxiliary connectors simulating connector 3 and connected beforehand to connector 2 to interact with and deactivate short-circuit members 55.

As compared with the known connectors described in the introduction, this therefore eliminates the need, not only for providing and connecting and disconnecting auxiliary connectors to and from connector 2 being tested, but also for manually counting the auxiliary connectors once the vehicle is wired, thus greatly reducing both the time and cost involved in assembling connecting unit 1 to the vehicle.

Clearly, changes may be made to connector 2 without, however, departing from the scope of the present invention.

What is claimed is:

1. An electric connector (2) comprising an insulating casing (15) defining at least two cavities (16) for housing respective electric terminals (17); and short-circuit means (55) carried by said casing (15) and which can be set to a first operating configuration in which said short-circuit means (55) mutually connect said terminals (17), and at least a second operating configuration in which said short-circuit means (55) are isolated electrically from said terminals (17); characterized in that said casing (15) is provided with a movable actuating member (62) cooperating with an actuation area (64) of said short-circuit means (55) to displace said short-circuit means (55) from said first to said second operating configuration.

2. A connector as claimed in claim 1, characterized in that said short-circuit means comprise at least one elastic blade (55) having a contact area (59) cooperating with said terminals (17) in said first operating configuration; said actuation area (64) being located at one end of said elastic blade (55).

3. A connector as claimed in claim 1, characterized in that said movable actuating member comprises a plate (62) extending transversely to an assembly direction (A) of said connector to a complementary connector (3) and connected to said casing (15) by resilient means (63).

4. A connector as claimed in claim 3, characterized in that said plate (62) comprises a push portion (65) located within the area of a lateral side of said casing (15).

5. A connector as claimed in claim 3, characterized in that said resilient means comprise two elastic connecting arms (63) allowing said plate (62) to move parallel to itself in a plane perpendicular to said assembly direction (A).

6. A connector as claimed in claim 1, characterized in that said movable actuating member (62) may be manually operated.

7. A connector as claimed in claim 1, characterized in that said movable actuating member (62) may be operated by a push member (81) located on a lateral side of a complementary connector (3).

8. A connector as claimed in claim 3, characterized in that said plate (62) is movable between a first rest position, in which it enables electrical contact between said short-circuit means (55) and said terminals (17), and a second active position, in which it forces said short-circuit means (55) out of contact with said terminals (17).

* * * * *